US010392904B2

(12) United States Patent
Wolf et al.

(10) Patent No.: US 10,392,904 B2
(45) Date of Patent: Aug. 27, 2019

(54) LATERAL JUNCTION FOR USE IN A WELL

(71) Applicant: Schlumberger Technology Corporation, Sugar Land, TX (US)

(72) Inventors: John C. Wolf, Houston, TX (US); Lance M. Rayne, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 552 days.

(21) Appl. No.: 14/767,547

(22) PCT Filed: Feb. 11, 2014

(86) PCT No.: PCT/US2014/015793
§ 371 (c)(1),
(2) Date: Aug. 12, 2015

(87) PCT Pub. No.: WO2014/126917
PCT Pub. Date: Aug. 21, 2014

(65) Prior Publication Data

US 2015/0376955 A1 Dec. 31, 2015

Related U.S. Application Data

(60) Provisional application No. 61/763,632, filed on Feb. 12, 2013.

(51) Int. Cl.
*E21B 7/06* (2006.01)
*E21B 29/06* (2006.01)
(Continued)

(52) U.S. Cl.
CPC ..... *E21B 41/0035* (2013.01); *E21B 7/04* (2013.01); *E21B 7/06* (2013.01); *E21B 29/06* (2013.01)

(58) Field of Classification Search
CPC ..... E21B 23/002; E21B 41/0035; E21B 7/06; E21B 29/06; E21B 17/023; E21B 7/04; E21B 17/025; E21B 7/061
See application file for complete search history.

(56) References Cited

U.S. PATENT DOCUMENTS 4,349,071 A * 9/1982 Fish ..... E21B 23/06 166/124
5,193,620 A 3/1993 Braddick
(Continued)

FOREIGN PATENT DOCUMENTS

RU 2073121 C1 2/1997
RU 2341639 C2 2/1997
(Continued)

*Primary Examiner* — Cathleen R Hutchins

(57) ABSTRACT

A technique facilitates creation of and production from a multilateral well. A lateral junction is deployed downhole to a lateral bore via a conveyance, such as a coiled tubing conveyance. The lateral junction comprises a main bore tubular and a lateral bore tubular which are pivotably joined via a pivotable coupling. The pivotable coupling enables pivoting of the lateral bore tubular outwardly through a lateral opening of the main bore tubular. The construction of the lateral junction enables establishment of a lateral junction, such as a TAML Level 3 or TAML Level 4 junction, in a single trip downhole.

18 Claims, 3 Drawing Sheets

(51) Int. Cl.
*E21B 7/04* (2006.01)
*E21B 41/00* (2006.01)

(56) References Cited

U.S. PATENT DOCUMENTS

| | | | | |
|---|---|---|---|---|
| 5,871,046 | A | 2/1999 | Robison | |
| 5,996,711 | A | 12/1999 | Ohmer | |
| 6,012,526 | A * | 1/2000 | Jennings | E21B 7/061 166/297 |
| 6,202,746 | B1 | 3/2001 | Vandenberg et al. | |
| 2002/0112857 | A1 | 8/2002 | Ohmer et al. | |
| 2004/0011529 | A1 * | 1/2004 | McGarian | E21B 41/0042 166/313 |
| 2004/0020648 | A1 | 2/2004 | Dewey et al. | |
| 2004/0262006 | A1 | 12/2004 | Dewey et al. | |
| 2009/0288879 | A1 | 11/2009 | Arena | |
| 2010/0307770 | A1 | 12/2010 | Sponchia et al. | |
| 2011/0120731 | A1 | 5/2011 | Robertson et al. | |
| 2011/0186291 | A1 | 8/2011 | Lang et al. | |
| 2012/0103687 | A1 | 5/2012 | Saurer | |

FOREIGN PATENT DOCUMENTS

| | | | |
|---|---|---|---|
| SU | 1682532 | A1 | 10/1991 |
| WO | WO2014059090 | A1 | 4/2014 |

* cited by examiner

LATERAL JUNCTION FOR USE IN A WELL

BACKGROUND

Hydrocarbon fluids such as oil and natural gas are obtained from a subterranean geological formation, referred to as a reservoir, by drilling a well that penetrates the hydrocarbon-bearing formation. Once a wellbore is drilled, various forms of well completion components may be installed to control and enhance the efficiency of producing the various fluids from the reservoir. Recovery from certain reservoirs is enhanced by drilling multilateral wells. In multilateral well applications, completion equipment is deployed to facilitate both creation of the multilateral well and production from the multilateral well.

SUMMARY

In general, a system and methodology are provided for facilitating creation of and production from a multilateral well. A lateral junction is deployed downhole to a lateral bore via a conveyance, such as a coiled tubing conveyance. The lateral junction comprises a main bore tubular and a lateral bore tubular which are pivotably joined via a pivotable coupling. The pivotable coupling enables pivoting of the lateral bore tubular outwardly through a lateral opening of the main bore tubular. The construction of the lateral junction enables establishment of a lateral junction, such as a TAML Level 3 or TAML Level 4 junction, in a single trip downhole.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
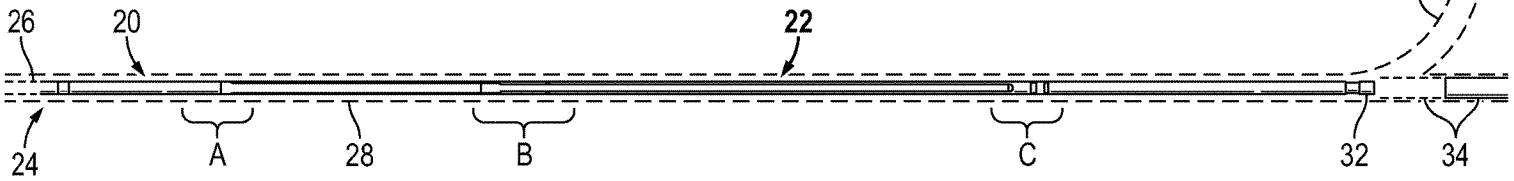
FIG. 1 is a schematic illustration of an example of a lateral junction being delivered downhole to an existing downhole completion via a conveyance, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate creation of and production from a multilateral well. A lateral junction is deployed downhole to a lateral borehole via a conveyance, such as a coiled tubing conveyance. The lateral junction comprises a main bore tubular and a lateral bore tubular which are pivotably joined via a pivotable coupling. The pivotable coupling enables pivoting of the lateral bore tubular outwardly through a lateral opening of the main bore tubular. As described in greater detail below, the main bore tubular may be in the form of or part of a completion module, e.g. a selective lateral intervention completion (SLIC) module, and the lateral bore tubular may be in the form of or part of a lateral entry guide. The construction of the lateral junction enables establishment of a lateral junction, such as a TAML Level 3 or TAML Level 4 junction, in a single trip downhole. In some applications, the lateral junction may be deployed through tubing for constructing a junction in casing at a position below a packer on the tubing. Additionally, the casing being exited via the junction may comprise single or multiple strings.

Embodiments described herein facilitate use of multilateral technology during the drilling of a new well or when working over existing wells to increase the reservoir contact and to thus enable increased production or production from marginal targets that do not justify the cost of a new well. Some existing through tubing multilateral ("ML") systems use jointed pipe and a rig (e.g. a snubbing unit, workover rig or even a drilling rig) for deployment when the running tools are to be rotated. However, embodiments according to the present disclosure may replace the work-over rig with a coiled tubing unit so that a continuous string of pipe may be used for milling the window, drilling the lateral, deploying the sandface completion and completing the junction. In some embodiments, a Technology Advancement of Multilaterals (TAML) Level 3 junction, defined as having mechanical support at the multilateral junction, may be used.

Some embodiments also may enable a TAML Level 4 junction which is a cemented junction, and some applications may allow creation of a TAML Level 5 junction which is defined as having hydraulic isolation. Additionally, some embodiments enable deployment without rotation of the pipe at surface while still providing rotation of the junction by using either downhole indexing or rotation devices, e.g. devices actuated by hydraulic pressure. This enables utilization of a coiled tubing unit for installation of the lateral junction even when the lateral junction is to be rotated into alignment with the lateral bore downhole.

At some point in the life of many types of wells, watered out zones are shut off or abandoned. Embodiments of the present disclosure also may be used to facilitate coiled tubing intervention to shut off a zone or to isolate the lateral bore or main bore. Various embodiments described herein also may reduce mobilization cost and increase the speed of tripping in and out of the wellbore to help make certain marginal reservoir targets productive targets.

In general, embodiments of the present disclosure provide the ability to install a TAML Level 3-4 junction without removing the production tubing. The embodiments also provide for a single trip installation, full intervention capability for both main and lateral legs of the completion, the same internal diameter above and below the casing exit window, and/or differential pressure isolation capability, e.g. 10,000 psi or greater differential pressure isolation capability, with respect to the lateral leg of the junction.

It should be noted that in some applications the SLIC module may be used as a standalone system to provide the operator with selective intervention capability for the lateral leg of the junction. In some embodiments, the SLIC module may be installed after the lateral junction has been constructed as part of the completion tubing string. When used in this way, the SLIC module provides selective through-tubing intervention by, for example, using a selective locking profile and an orientation feature located below the window section. Two seal bores, one above the window and one below, provide a capability to isolate the lateral leg when an isolator tool is installed in the SLIC module. This means that production can flow from the main bore past the lateral leg of the junction without co-mingling with the lateral leg, while the lateral leg is effectively shut off from producing. In some embodiments, the isolator can withstand up to 10,000 psi or more of differential pressure. If the operator desires to access the lateral leg of the junction, a deflector tool may be installed through the tubing string, thus allowing through-tubing intervention of the lateral leg with either coiled tubing or wireline. If the operator desires to produce from both legs of the multilateral junction, intervention tools may be removed and co-mingled production may be achieved through the tubing string. In some embodiments, this takes place without removing the upper completion or wellhead and without mobilizing a conventional work-over rig.

In embodiments described herein, a lateral entry guide, e.g. a lateral bore tubular, is combined with a main bore tubular of the SLIC module to form a lateral junction, e.g. a lateral junction conveyed by coiled tubing. These types of embodiments provide a system which may be used where a conventional completion has been installed in a well without an existing multilateral junction. If the operator re-works the well to increase production and desires to drill an additional lateral in the well, through tubing whipstocks may be used to drill the lateral without removing the existing tubing completion. Currently, however, there are limited options for installing a multilateral junction without removing the production tubing. By utilizing the combined main bore tubular and lateral bore tubular, it becomes possible to install a TAML Level 3-4 junction through the production tubing in a single trip. Embodiments described herein combine the lateral bore and main bore legs of the lateral junction within the same assembly, thus removing the previously used procedure of stroking a lateral tube through a main bore deflector. This provides the largest possible through bore internal diameter to the main bore leg of the lateral junction while providing a junction that can still fit through a tubing completion.

In some embodiments, installation of the lateral junction via coiled tubing involves an operator positioning the assembly above a tubing exit window. By using an orientation sub (e.g. measurement-while-drilling sub or Gyro sub) and an indexing sub or downhole motor assembly, the lateral junction may be positioned in alignment with the tubing exit window. The operator then applies hydraulic pressure to an installation tool, thus forcing the lateral entry guide/lateral bore tubular laterally outwards away from the main bore tubular, e.g. away from the SLIC module body. A retainer, e.g. a shearable band, may be used to hold the lateral bore tubular against premature movement in a lateral direction. Sufficient force may be applied to shear the band (or otherwise release the retainer) before the lateral bore tubular can be deflected outwardly. Once the lateral bore tubular is shifted laterally, the operator strokes the lateral junction assembly downwards guiding the lateral bore tubular into the lateral bore of the well and the main bore tubular farther into the main bore of the well. After the lateral entry guide/lateral bore tubular is fully inserted into the lateral leg of the well, the main bore tubular, e.g. the SLIC module, may be anchored in place. After anchoring, the installation tool can be removed.

Referring generally to FIG. 1, an example of a well system 20 is illustrated as comprising a lateral junction 22 deployed into a well 24 via a conveyance 26, such as a coiled tubing conveyance. The well 24 may be a multilateral well having a main bore 28 and at least one lateral bore 30. The lateral junction 22 is designed for deployment downhole via coiled tubing conveyance 26 (or another suitable type of conveyance) to create a junction between the main bore 28 and a designated lateral bore 30 in a single trip downhole. As described above, the lateral junction 22 may be used to establish, for example, a TAML Level 3 or TAML Level 4 Junction. The lateral junction 22 may comprise a downhole sub 32 constructed for engagement with downhole equipment 34 previously placed in main bore 28 of well 24. By way of example, the downhole equipment 34 may comprise a production tubing string or other downhole completion equipment. In some applications, the lateral junction 22 may be conveyed down through tubing and through a packer on the tubing for constructing a junction in casing below the packer.

Figure 2:
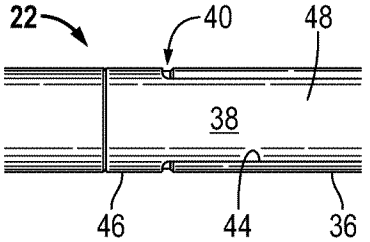
FIG. 2 is an enlarged view of a portion A of the lateral junction illustrated in FIG. 1, according to an embodiment of the disclosure.
Figure 3:
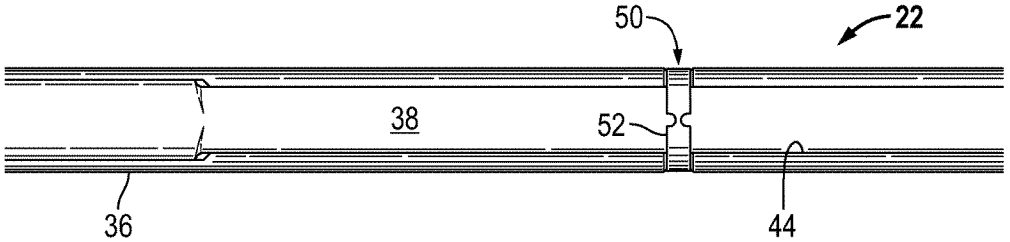
FIG. 3 is an enlarged view of a portion B of the lateral junction illustrated in FIG. 1, according to an embodiment of the disclosure.
Figure 4:
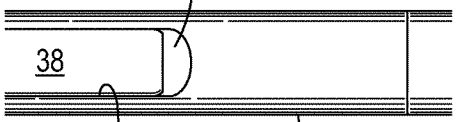
FIG. 4 is an enlarged view of a portion C of the lateral junction illustrated in FIG. 1, according to an embodiment of the disclosure.

FIGS. 2, 3 and 4 illustrate enlarged portions of lateral junction 22 designated in FIG. 1 as portions A, B and C, respectively. In the embodiment illustrated in these figures, the lateral junction 22 comprises a main bore tubular 36 and a lateral bore tubular 38. As described above, the main bore tubular 36 may be in the form of a SLIC module or other suitable tubular module and the lateral bore tubular 38 may be in the form of a lateral entry guide.

As illustrated in FIG. 2, the lateral bore tubular 38 is connected to the main bore tubular 36 via a pivotable coupling 40. The pivotable coupling 40 allows the lateral bore tubular 38 to pivot with respect to main bore tubular 36 between a first or nested position and a second or laterally extended position. In the nested position, the lateral bore tubular 38 is substantially received within an interior 42 of main bore tubular 36 (see FIG. 4). For example, the lateral bore tubular 38 may be nested within an outer diameter of the main bore tubular 36 to facilitate conveyance of the lateral junction 22 downhole along main bore 28 toward lateral bore 30. In the laterally extended position, the lateral bore tubular 38 is pivoted in a laterally outward direction through a lateral opening 44 formed in the sidewall of main bore tubular 36.

In the embodiment illustrated, the lateral bore tubular 38 is affixed to main bore tubular 36 at an affixed end 46 proximate pivotable coupling 40. Additionally, the pivotable coupling 40 is illustrated as formed via a flex region 48 along which the lateral bore tubular 38 flexes to accommodate movement between the first, nested position and the second, laterally extended position. However, other types of pivotable couplings 40, e.g. hinges or joints, may be used to pivotably couple lateral bore tubular 38 with main bore tubular 36. To maintain the lateral bore tubular 38 in the nested position within main bore tubular 36 during movement downhole along main bore 28, a retainer 50 may be used to temporarily hold the lateral junction 22 in the nested configuration. By way of example, the retainer 50 may comprise a shear member 52, such as a shearable band extending around at least a portion of the circumference of the lateral junction 22.

Figure 5:
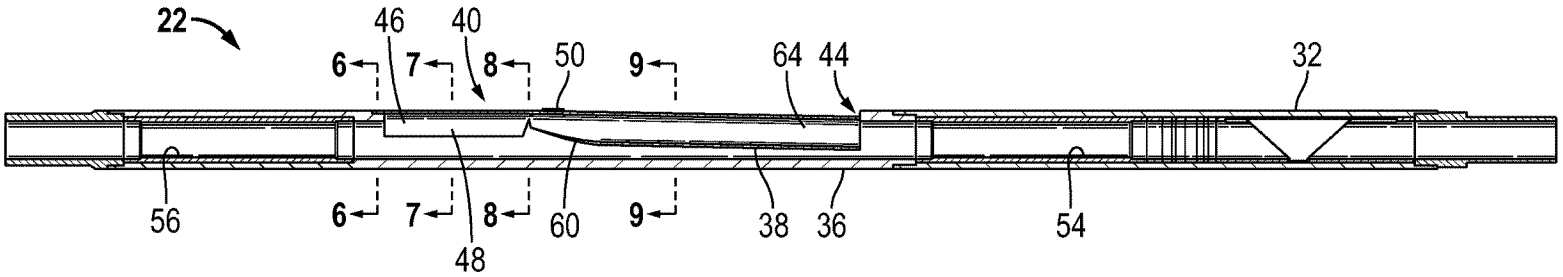
FIG. 5 is a cross-sectional view taken along an axis of the lateral junction illustrated in FIG. 1, according to an embodiment of the disclosure.

As illustrated in FIGS. 5-9, the lateral junction 22 may comprise additional and/or other features depending on the specifics of a given application. As illustrated in FIG. 5, lateral junction 22 may comprise a lower or downhole seal bore 54 located downhole of lateral opening 44. In the example illustrated, the lower seal bore 54 is positioned between lateral opening 44 and downhole sub 32. The lateral junction 22 also may comprise an upper or uphole seal bore 56 located uphole of lateral opening 44. The lower seal bore 54 and upper seal bore 56 may be used to sealably engage a variety of tools deployed into the lateral junction 22. For example, a variety of isolator devices may be deployed into the lateral junction 22 to isolate or block flow from lateral bore 30 and/or main bore 28.

Figure 6:
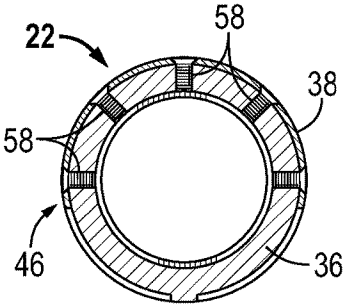
FIG. 6 is a cross-sectional view taken generally perpendicular to an axis of the lateral junction illustrated in FIG. 5 at a location marked by line 6-6, according to an embodiment of the disclosure.

As illustrated in the cross-sectional views of FIGS. 6-9, the configuration of lateral bore tubular 38 may change along its length. At affixed end 46, for example, the lateral bore tubular 38 may be partially circumferential and may be affixed to main bore tubular 36 via a plurality of fasteners 58, as illustrated in FIG. 6. By way of example, fasteners 58 may comprise screws or other threaded fasteners extending through the lateral bore tubular 38 and threaded into engagement with main bore tubular 36. However, fasteners 58 also may comprise a variety of latches, retention rings, weldments, or other suitable fasteners.

Figure 8:
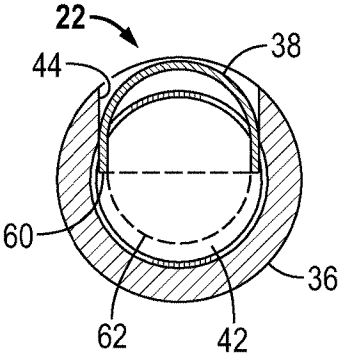
FIG. 8 is a cross-sectional view taken generally perpendicular to an axis of the lateral junction illustrated in FIG. 5 at a location marked by line 8-8, according to an embodiment of the disclosure.
Figure 7:
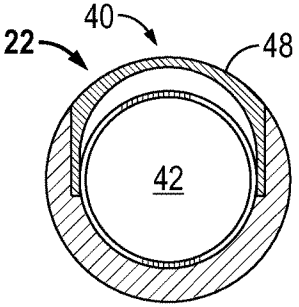
FIG. 7 is a cross-sectional view taken generally perpendicular to an axis of the lateral junction illustrated in FIG. 5 at a location marked by line 7-7, according to an embodiment of the disclosure.

The flex region 48 of lateral bore tubular 38 also may be an open structure, as illustrated in FIG. 7, rather than extending through a full circumference to form an enclosed tube at this region of the lateral bore tubular 38. This type of structure facilitates flexing and thus the movement of lateral bore tubular 38 between the first, nested position and the second, laterally expanded position relative to main bore tubular 36. As illustrated in FIGS. 5 and 8, the lateral bore tubular 38 also may have an engagement region 60 located along or downhole of flex region 48. Engagement region 60 may comprise a sloped surface or other type of feature constructed for engagement with an actuating tool 62 which is shown in dashed lines in FIG. 8.

Figure 9:
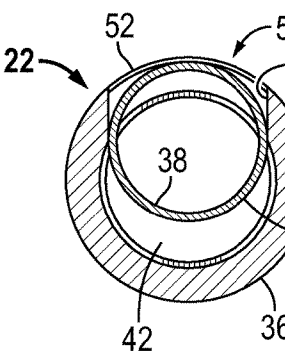
FIG. 9 is a cross-sectional view taken generally perpendicular to an axis of the lateral junction illustrated in FIG. 5 at a location marked by line 9-9, according to an embodiment of the disclosure.

The actuating tool 62 may be moved downhole into lateral junction 22 and into contact with engagement region 60. If the lateral junction 22 has been properly rotated, as described above, to align lateral opening 44 with lateral bore 30, hydraulic actuation or other continued movement of actuating tool 62 causes the lateral bore tubular 38 to pivot laterally outwardly and to shear or otherwise release retainer 50. The continued movement of actuating tool 62 causes a tubular downhole end 64 to extend laterally through opening 44 (see FIG. 9 showing end 64 prior to full lateral movement through opening 44).

Figure 10:
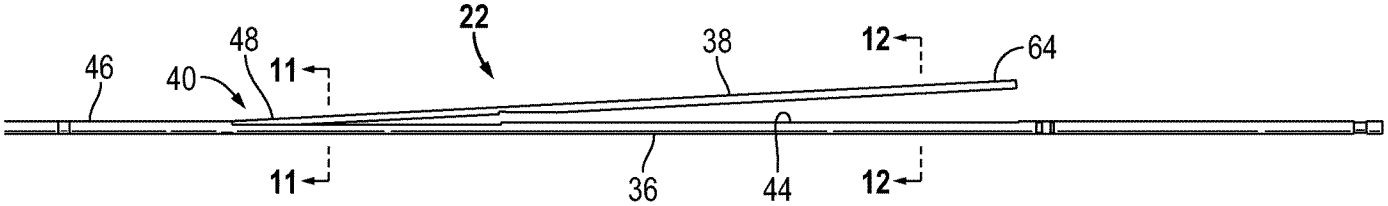
FIG. 10 is a schematic illustration of an example of the lateral junction in an expanded state enabling its use as a junction between a lateral bore and a main bore, according to an embodiment of the disclosure.
Figure 12:
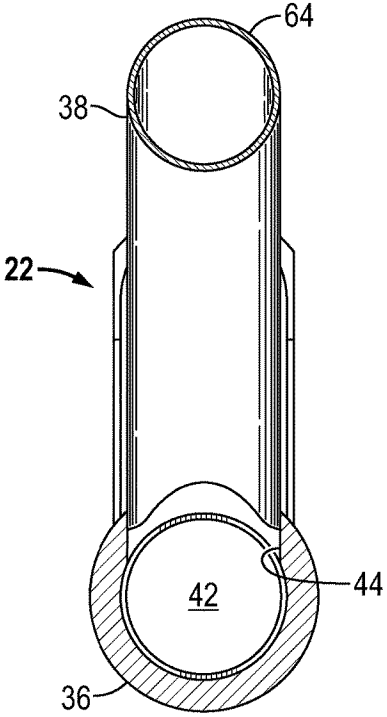
FIG. 12 is a cross-sectional view taken generally perpendicular to an axis of the lateral junction illustrated in FIG. 10 at a location marked by line 12-12, according to an embodiment of the disclosure.
Figure 11:
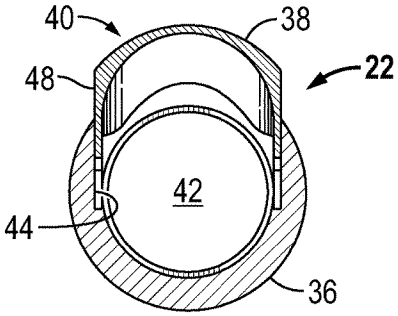
FIG. 11 is a cross-sectional view taken generally perpendicular to an axis of the lateral junction illustrated in FIG. 10 at a location marked by line 11-11, according to an embodiment of the disclosure.

Once the tubular downhole end 64 of lateral bore tubular 38 extends sufficiently through lateral opening 44, the lateral junction 22 may be moved farther downhole which forces lateral bore tubular 38 into lateral bore 30 and main bore tubular 36 into main bore 28. As the lateral bore tubular 38 and main bore tubular 36 move farther into lateral bore 30 and main bore 28, respectively, the lateral bore tubular 38 and main bore tubular 36 remain affixed to each other at affixed end 46, as illustrated in FIGS. 10-12. The pivotable coupling 40, e.g. flex region 48, allows the lateral bore tubular 38 to pivot away from main bore tubular 36, as illustrated in FIG. 11. The pivotable coupling 40 also ensures proper insertion of tubular sections into both the lateral bore 30 and the main bore 28, as illustrated in FIGS. 10 and 12. Thus, the junction, e.g. a TAML Level 3 or TAML Level 4 junction, may be created in a well, e.g. a multilateral well, with a single trip downhole.

Depending on the parameters of a given application, the structure and components of the downhole equipment 34, lateral junction 22, and/or conveyance 26 may vary. Many types of completions or other well equipment also may be deployed in, for example, the lateral bore and above the lateral junction. Various tools may be used in cooperation with the lateral junction to enable or block fluid flow along the main bore or lateral bore. Additionally, multiple lateral junctions 22 may be used at multiple lateral boreholes extending from the main bore in many types of multilateral wells.

The lateral junction 22 also may have other and/or additional features and components. For example, the pivotable coupling may have a variety of forms to provide the pivoting, lateral movement of the lateral bore tubular with respect to the main bore tubular. The main bore tubular and the lateral bore tubular may be constructed with many types of engagement features for engaging specific types of completions or other downhole equipment for a given application. The lateral junction also may be constructed without seal bores or with different numbers of seal bores. The sizes, lengths, and materials of the main bore tubular and the lateral bore tubular also may vary and may be selected according to the parameters of a given application. Many types of tools and engagement features also may be used to initiate outward pivoting of the lateral bore tubular with respect to the main bore tubular. In some applications, pivoting of the lateral bore tubular may be accomplished by an actuator located in the lateral junction. For example, a hydraulic, electro-mechanical, or mechanical actuator may be positioned in the lateral junction and selectively actuated to extend the lateral bore tubular outwardly through the lateral opening.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a lateral junction having a main bore tubular and a lateral bore tubular, the main bore tubular comprising a lateral opening and the lateral bore tubular being connected to the main bore tubular via a pivotable coupling, the pivotable coupling being located to accommodate pivoting motion of the lateral bore tubular with respect to the main bore tubular between a first position wherein the lateral bore tubular is nested within the main bore tubular and a second position wherein the lateral bore tubular extends laterally through the lateral opening for insertion into a lateral bore of the well, wherein the pivotable coupling comprises a flex region of the lateral bore tubular, which allows the lateral bore tubular to pivot relative to the main bore tubular via flexing, and wherein the flex region comprises an open structure that does not extend through a full circumference to form an enclosed tube at the lateral bore tubular.

2. The system as recited in claim 1, wherein the lateral bore tubular is initially held in the first position within the main bore tubular by a retainer to facilitate movement of the lateral junction downhole into the well in a single trip.

3. The system as recited in claim 2, wherein the retainer comprises a shearable band.

4. The system as recited in claim 1, wherein the main bore tubular comprises an upper seal bore located uphole of the lateral opening.

5. The system as recited in claim 1, wherein the main bore tubular comprises a lower seal bore located downhole of the lateral opening.

6. The system as recited in claim 1, wherein the main bore tubular comprises an upper seal bore located uphole of the lateral opening and a lower seal bore located downhole of the lateral opening.

7. The system as recited in claim 1, wherein the main bore tubular comprises a downhole sub positioned to engage an existing downhole tubing string.

8. The system as recited in claim 1, further comprising coiled tubing coupled to the lateral junction to run the lateral junction downhole in a single trip.

9. A method for establishing a lateral junction downhole, comprising:

coupling a lateral bore tubular with a main bore tubular via a pivotable coupling to form a lateral junction;

nesting the lateral bore tubular in a nested position within the main bore tubular adjacent a lateral opening in the main bore tubular;

moving the lateral junction downhole along a main bore into proximity with a lateral bore;

pivoting the lateral bore tubular outwardly through the lateral opening;

extending the lateral bore tubular to an extended position; and continuing movement of the lateral junction in a downhole direction to move the lateral bore tubular into the lateral bore and the main bore tubular farther into the main bore while remaining coupled at the pivotable coupling, wherein the coupling step comprises flexibly coupling the lateral bore tubular to the main bore tubular using a flex region of the lateral bore tubular, wherein the flex region comprises an open structure that does not extend through a full circumference to form an enclosed tube at the lateral bore tubular.

10. The method as recited in claim 9, further comprising retaining the lateral bore tubular nested in the main bore tubular with a retainer while moving the lateral junction downhole toward the lateral bore.

11. The method as recited in claim 9, wherein nesting comprises nesting the lateral bore tubular within an outside diameter of the main bore tubular.

12. The method as recited in claim 9, wherein coupling further comprises securing the lateral bore tubular to the main bore tubular with a plurality of fasteners.

13. The method as recited in claim 9, wherein pivoting comprises using a tool to initiate lateral outward movement of the lateral bore tubular.

14. The method as recited in claim 9, wherein moving comprises moving the lateral junction downhole via coiled tubing.

15. The method as recited in claim 9, further comprising rotating the lateral junction in the main bore to align the lateral opening with the lateral bore.

16. A system, comprising:

a coiled tubing conveyance; and a lateral junction releasably coupled to the coiled tubing conveyance, the lateral junction comprising:

a main bore tubular;

a lateral bore tubular;

a flex region pivotably coupling the lateral bore tubular with the main bore tubular, wherein the flex region comprises an open structure that does not extend through a full circumference to form an enclosed tube at the lateral bore tubular; and a retainer to temporarily retain the lateral bore tubular in a nested position within the main bore tubular as the lateral junction is moved downhole along a main bore.

17. The system as recited in claim 16, wherein the main bore tubular comprises a lateral opening positioned to enable lateral pivoting motion of the lateral bore tubular.

18. The system as recited in claim 16, wherein the retainer comprises a shearable retainer.

* * * * *